United States Patent [19]

Heng et al.

[11] Patent Number: 4,830,627

[45] Date of Patent: May 16, 1989

[54] SCREW-TYPE CONNECTING MEANS FOR WIRES AND LUGS

[75] Inventors: Jean-Paul Heng, Lyons; Jean-Claude Bidal, Reyrieux; René Curvat, Rillieux La Pape, all of France

[73] Assignee: CGEE Alsthom, Levallois-Perret, France

[21] Appl. No.: 160,940

[22] Filed: Feb. 26, 1988

[30] Foreign Application Priority Data

Feb. 27, 1987 [FR] France ..... 87 02672

[51] Int. Cl.[4] ..... H01R 4/38

[52] U.S. Cl. ..... 439/586

[58] Field of Search ..... 439/586, 801, 806, 807, 439/813, 709, 712, 713

[56] References Cited

U.S. PATENT DOCUMENTS

| | | | |
|---|---|---|---|
| 3,129,049 | 4/1964 | Anderson | 439/586 X |
| 3,414,866 | 12/1968 | Norden | 439/586 |
| 3,648,213 | 3/1972 | Kobler | 439/586 |
| 4,527,849 | 7/1985 | Marach | 439/712 X |
| 4,542,953 | 9/1985 | Iwamoto et al. | 439/801 X |
| 4,743,204 | 5/1988 | Fromm et al. | 439/807 |

FOREIGN PATENT DOCUMENTS

| | | | |
|---|---|---|---|
| 1991598 | 8/1968 | Fed. Rep. of Germany . | |
| 2845607 | 5/1979 | Fed. Rep. of Germany | 439/807 |
| 2827143 | 1/1980 | Fed. Rep. of Germany | 439/586 |
| 2175351 | 10/1973 | France . | |
| 2333362 | 6/1977 | France . | |
| 2451151 | 10/1980 | France . | |
| 2462793 | 3/1985 | France . | |
| 2563947 | 8/1985 | France . | |
| 141885 | 5/1980 | German Democratic Rep. | 439/801 |
| 144990 | 11/1980 | German Democratic Rep. | 439/801 |
| 647101 | 12/1984 | Switzerland | 439/801 |
| 2044877 | 10/1980 | United Kingdom . | |
| 2056793 | 3/1981 | United Kingdom . | |

*Primary Examiner*—William Briggs

*Attorney, Agent, or Firm*—Sughrue, Mion, Zinn, Macpeak & Seas

[57] ABSTRACT

At least one terminal is provided comprising a screw (3) for securing wires and/or wire terminal lugs between a conducting wall of a connecting link (2) and a clamping plate (4) both traversed by the screw which also pulls together. Terminal is lodged in an insulating case (1) and comprises a screw retainer (1B4, 1B5) molded with the case and arranged to both guide the screw in its longitudinal travel between an open position in which the screw, the connecting link and the clamping plate leave open a passage from a wire ring-tongue terminal and a blocking position in which the clamping plate and the connecting link are brought together and retract the screw into an open position into the retainer by the latter's pressure against the bottom of the screw head.

11 Claims, 4 Drawing Sheets

FIG. 7
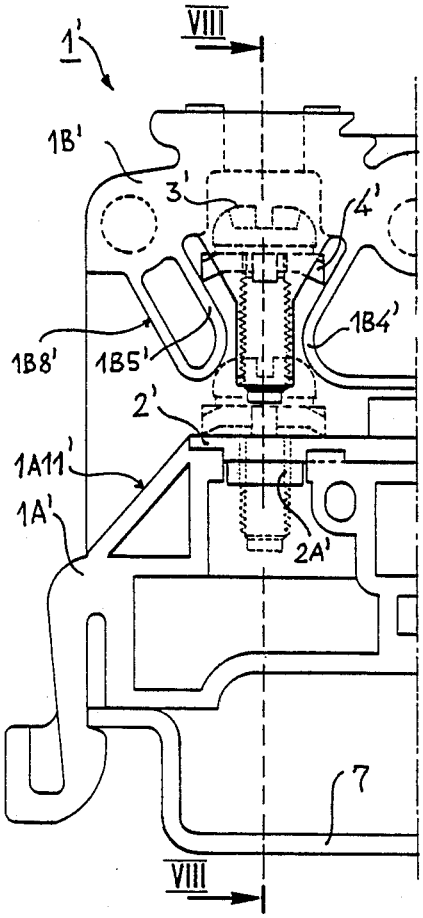
FIG. 8
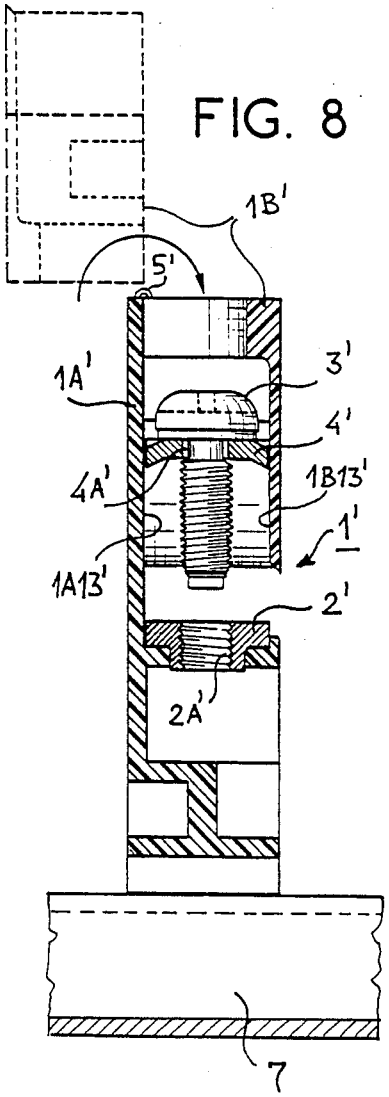
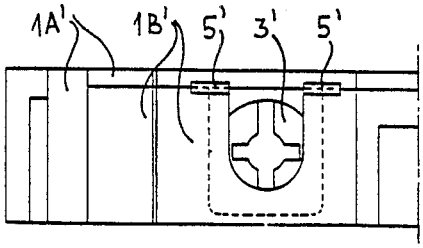
FIG. 9

SCREW-TYPE CONNECTING MEANS FOR WIRES AND LUGS

FIELD OF THE INVENTION

This invention concerns connecting means for electrical wires and/or wire terminal lugs in which at least one terminal comprises a screw designed to fix at least one wire and/or wire terminal lug between a conducting wall of a connecting part and a clamping plate, both the conducting wall and the clamping plate being traversed by the screw which serves to bring them connectively together.

BACKGROUND OF THE INVENTION

There is prior art of long standing in the manufacture of such terminals, embodied in a wide variety of connecting means, for example in a simple junction block enabling connection of electrical wires, a switch or any other small electrical apparatus.

Since the terminal screw of such terminal is generally made to engage by screwing, with or into the connecting part within the insulating housing containing all or part of the connecting means, it is not possible to insert a closed tongue between the clamping plate and the connecting part of the connecting terminal without having beforehand completely unscrewed the screw, to lift it up, and thus created a passage for the closed tongue.

Such complete unscrewing of the screws entails the risk of loss of one or more screws if no precautions are taken to avoid same.

The risk of loss is not limited only to the case of installing closed tongue terminals, as for convenience one tends to use the same connecting terminals for open-tongue wire terminals, closed terminals and wires and consequently it is possible to inadvertently unscrew and lose a screw when merely installing an open wire terminal or a wire. Experience shows that this risk increases as the size of the connecting terminals decreases.

Meanwhile, the technological trend is for miniaturization of the components making up such screw terminals and the connecting means in which they are comprised, and for reduction of the manufacturing costs associated with said components, and likewise of the cost of assembly by the manufacturer and of implementation by installers.

SUMMARY OF THE INVENTION

This invention therefore provides connecting means for electrical wires and/or wire terminal lugs having at least one connecting terminal comprising a screw designed to fix at least one wire and/or wire terminal lug between a conducting wall of a connecting part and a clamping plate, both the conducting wall and the clamping plate being traversed by the screw which serves to bring them connectively together, said connecting terminal being housed in a case of insulating material having and inlet for introducing the wire and/or the wire terminal lug and an opening for accessing the head of the screw for purposes of maneuvering said screw.

According to one of the features of the invention, the connecting terminal comprises one of the screw retaining means molded with the case and arranged to on the one hand guide the screw in its longitudinal movements between an open position in which the screw, the connecting part and the clamping plate leave between them a passage for a wire terminal, and a blocking position in which the clamping plate and the connecting part are brought together, and on the other hand retract the screw in open position into the screw retainer, by the latter's pressing beneath the screw head at least at the end of unscrewing.

BRIEF DESCRIPTION OF THE DRAWINGS

The invention, its features and advantages will now be described with reference to the appended drawings, in which:

FIGS. 7, 8 and 9 respectively show a half front view of another embodiment of the invention, a cross section along line VIII—VIII of that embodiment and a half top view of that embodiment.

DESCRIPTION OF THE PREFERRED EMBODIMENTS

Figure 1:
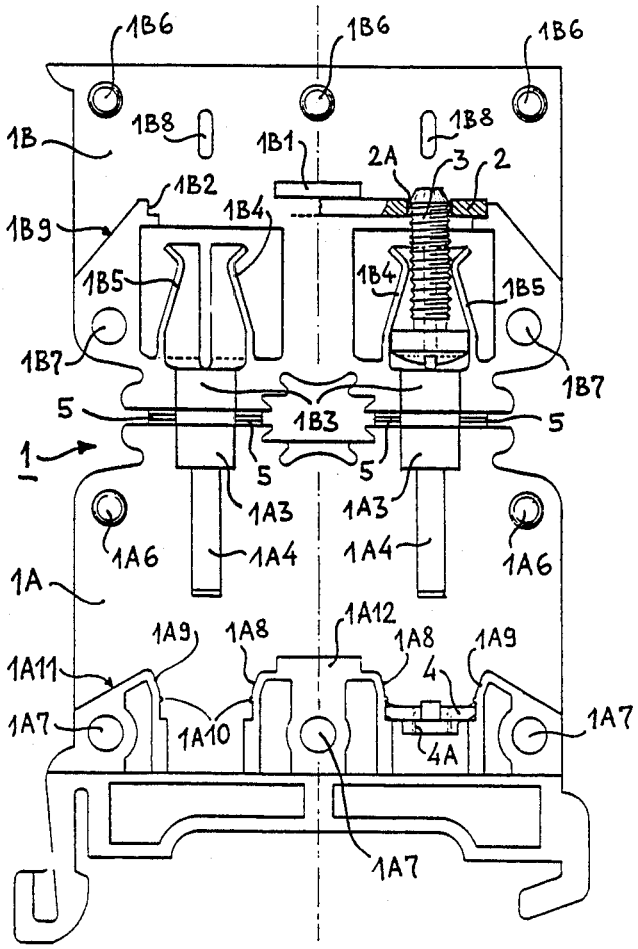
FIG. 1 is a diagrammatic front view of one example of a connecting means according to the invention, in open position during manufacturing assembly.

The inventive connecting means for electrical wires and/or wire terminal lugs illustrated in FIG. 1 is, as shown, designed to accommodate two terminals for wires and/or wire terminal lugs. The embodiment shown consists of a junction box installable on standard rails, but it should be understood that the means claimed are also applicable to other electrical equipment, and namely to switches for instance.

In the embodiment illustrated, the connecting means consist of a case 1 of insulating material, comprising two mating parts 1A, 1B providing at least one housing for at least one connecting link 2, one screw 3 and one clamping plate 4, which the screw 3 traversing said clamping plate and likewise the connecting link, can bring together with said connecting link, to trap thereagainst at least one wire or wire terminal lug to be connected.

No specific wire terminal lug has been shown in the drawing, though such terminal could be either a classic open-ended terminal lug, whose C-shaped "spade" installs sandwiched between a conducting wall of the connecting link and the clamping plate when the screw is tightened, or a classic closed-end terminal lug such as a ring-tongue terminal which must be threaded onto the terminal post during connection.

Figure 2:
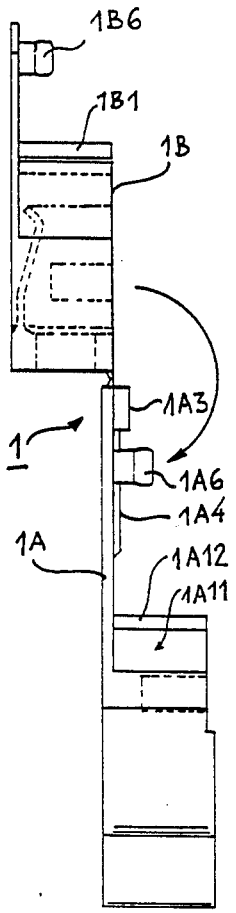
FIG. 2 is a view of the left side of the connecting means shown in FIG. 1.

In the preferred embodiment, the mating parts 1A, 1B are preferably molded in open position such as shown in FIGS. 1 and 2, of an insulating plastic material, for instance polyamide, said two mating parts being joined by a flexible strap 5 molded integrally with them.

Also in the preferred embodiment, the connecting link 2 of one terminal post is of the strip type and is made from a strip of highly conductive metal having a drilled opening for passage of the screw allowing to guide the screw 3 in its longitudinal movements. The connecting strip is in this case immobilized in a compartment purposely provided in part 1B of the case in which it is inserted by a simple transverse sliding. This compartment is for example bounded by relief or projecting parts such as tab 1B1 or by hollowed or recessed portions left in said projecting parts, such as the transverse groove 1B2. The strip is for example immobilized by mere pinching as long as the two parts 1A and 1B are not mated. As an alternative the connecting link can be made by metal deposition on an inside wall of the case, traversed by screw 3, such as to apply the clamping plate 4 thereto.

Figure 4:
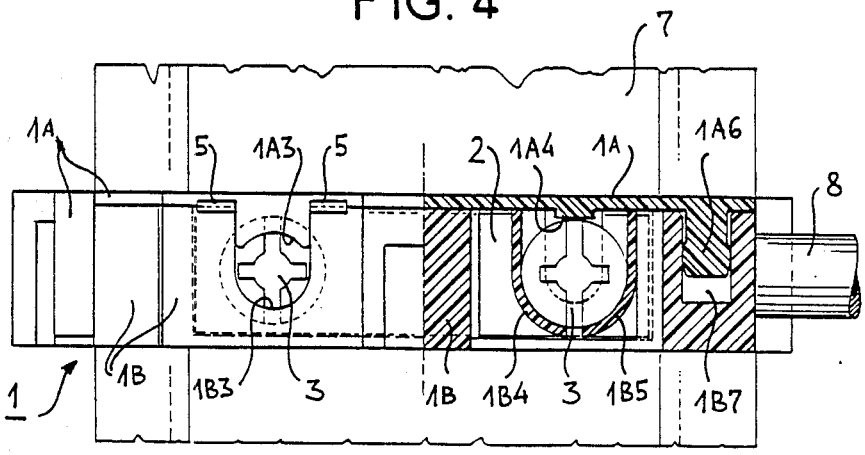
FIG. 4 is a top view, partly in cross section, of the means presented in FIG. 3.
Figure 5:
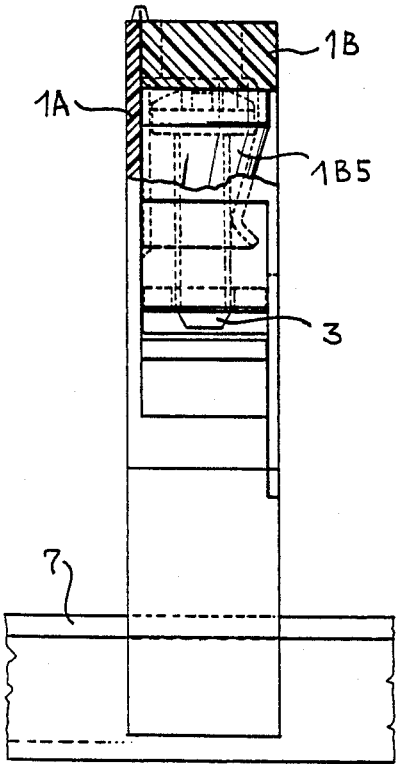
FIGS. 5 and 6 respectively show a view from the right side, cut away along line V—V of FIG. 3 and a like view, cut away along line VI—VI of the same figure.

The screw 3 provided for a terminal in connecting means according to the invention is a screw with a head and shoulder which can therefore be lifted by acting on the bottom periphery of the head. Its head is preferably cross-slotted with one of the perpendicular slots extending to the periphery to allow discretionary use of a plain, flat tipped screwdriver or a cross-point screwdriver (see FIG. 4).

Figure 6:
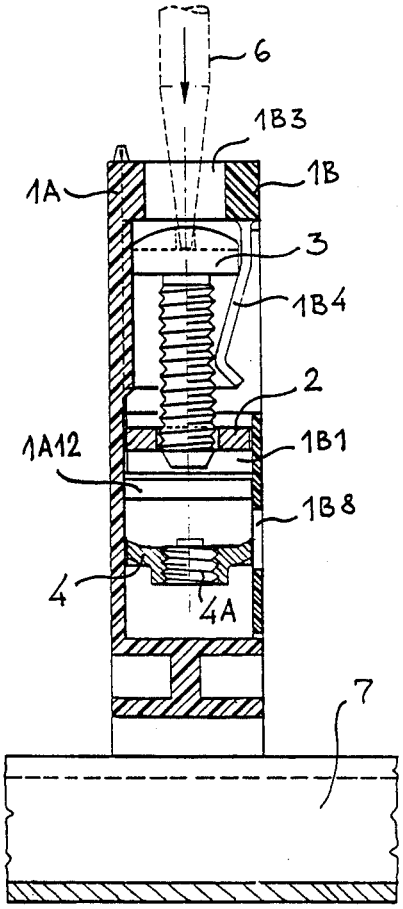

Each screw 3 is centered in an opening of the case 1 to allow access to its head from the outside of the assembled case, with a screwdriver 6 (FIG. 6). This opening is bounded at each terminal here by two complementary grooves 1A3, 1B3 each provided in the inner edge of a different part 1A, 1B to form a tool passageway when the two parts are mated.

The passageway formed by the two complementary groove portions 1A3, 1B3 of a terminal is located in alignment with the holes provided in the connecting link 2 and in the clamping plate for the screw of that terminal.

The screw 3 of a terminal comes into position beneath the passageway formed by the two complementary portions 1A3, 1B3 with its head under the passageway and its shank, opposite said passageway, in the hole of the connecting link 2, in the example given in FIGS. 1 through 6.

The screw is installed in a retainer comprising at least two elastic extensions 1B4, 1B5 which come into position inside the assembled case such as to form a screw retaining chimney beginning, within the case, under the screw head access opening formed by the groove portions 1A3 and 1B3.

In the preferred embodiment, these elastic extensions are provided in the face of one of the two mating case parts that is located inside the case when the case is closed; the face, termed the inside face, of the other mating part, which confronts the first just-mentioned face, completes the chimney-like holding cage in which the screw settles.

The two elastic extensions 1B4, 1B5, carried by the part 1B relevant to one terminal, and the inner wall of the other part 1A define a chimney having here a divergent biconical and at least partly cylindrical, tulip-like shape in which the screw head settles at the edge of the passageway formed by the complementary groove portions 1A3, 1B3 provided for that terminal, under the urging of the centripetal pressure of the internal walls of said elastic extensions. The screw 3 shank is held centered in the screw access opening and the connecting link 2 hole by the two elastic extensions which taper against it under the head. This makes it possible to hold the screw 3 in place within the part 1B during assembly, prior to closing the two mating parts of the case, as the screw's shank penetrates into the hole of the connecting link 2, provided a sufficiently long shank is chosen.

The screw 3 head of a terminal also comes to bear laterally against the inside wall of the part 1A after the complementary part 1B carrying it is folded down when the case is assembled. This prevents any screw movement other than longitudinal translation.

In the preferred embodiment, a guiding runner 1A4 is provided along the inside wall of the part 1A to guide the screw head throughout its possible range of travel in translation within the case.

As previously stated, the elastic extensions 1B4, 1B5 of a terminal define a basically double conical chimney which widens beyond the region where the extensions bear centeringly against the shank of the screw 3 and towards the hole provided in the connecting link 2.

In the chosen example, the free end of these extensions 1B4, 1B5 stops at a distance from the connecting link 2, above the hole in said link which they overhang, such that the screw head is no longer engaged therewith, at least when the screw is in contact with the connecting link 2 by the overhanging, bottom part of its head. The extensions are then in their equilibrium position and do not press on the screw.

It should be obvious that without departing from the scope of the invention, more such extensions could be provided and they could be distributed either on the other mating part 1A or on both parts 1A and 1B.

In accordance with the invention, the clamping plate 4 of a terminal, which is threaded to receive the terminal's screw 3, is embedded in a suitable compartment in the inside face of part 1A against which part 1B, equipped as described above, closes.

The disposition of this compartment is selected so as to position and keep the clamping plate in part 1A during assembly.

For this purpose the plate comprises bearing surfaces enabling it to be locked against rotation and against translation, for example by pinching, pending engagement of the screw. The plate shown here is simply a square plate with a tapped, center through hole 4A and is positioned by a lateral push into its compartment.

The plate compartment is arranged so that the screw 3 of the terminal to which the plate belongs will position itself in front of the tapped hole 4A when the two parts 1A, 1B are foldingly mated, for example, by snapping together pins 1A6 and 1B6 on parts 1A and 1B respectively and corresponding snap catches 1B7 and 1A7. In the example shown, the clamping plate 4 is squeezed between slightly elastic walls 1A8, 1A9 which are in this case further provided with very small retaining protrusions 1A10.

The manufacture of a connecting block such as illustrated in FIGS. 1 through 6 is thus a simple matter. After molding the pairs of mating parts 1A and 1B, held together by their hinge straps 5, the connecting links 2, screws 3 and clamping plates 4 are fabricated merely by inserting these parts into retainable position in their respective compartments, namely some in mating part 1A and others in mating part 1B, and folding the two mating parts together. Thanks to perforations 1B8 made in part 1B, the presence of the clamping plates can be checked visually even with the block closed.

The operation of the terminals of the connecting means according to the invention will now be described with reference to FIGS. 3 through 6, in which the means are represented mounted on a standard shaped mounting rail 7.

Once the block has been assembled, the plates 4 of that block are locked in their compartments in mating part 1A by the inside wall of part 1B, whereas the screws and, in the case at hand, the connecting link 2 common to both terminals shown are held in part 1B by the inside wall of part 1A, the connecting link being completely immobilized therein.

The screw heads are captive between extensions 1B4 and 1B5 which direct the screw shanks to the center of the tapped holes 4A in the clamping plates. The screws are accessible via the openings defined by the complementary half-grooves 1A3, 1B3 joined together.

In a preferred embodiment allowing hookup of wires and both open and closed-ended wire terminal tongues, the length of the screw 3 shanks is selected to leave a space for inserting closed terminals, said space being slightly higher than the maximum allowable thickness of the terminal tongues, to allow the end of a ring-tongue to pass between the screw and plate.

Pushing the head of a screw 3 with a scewdriver tip 6, as shown in FIG. 6, drives this screw's shank into the tapped hole 4A of its facing clamping plate, into which said screw shank screws when the screwdriver is turned, and the corresponding elastic extensions 1B4, 1B5 are outwardly urged by the periphery of the screw head.

Figure 3:
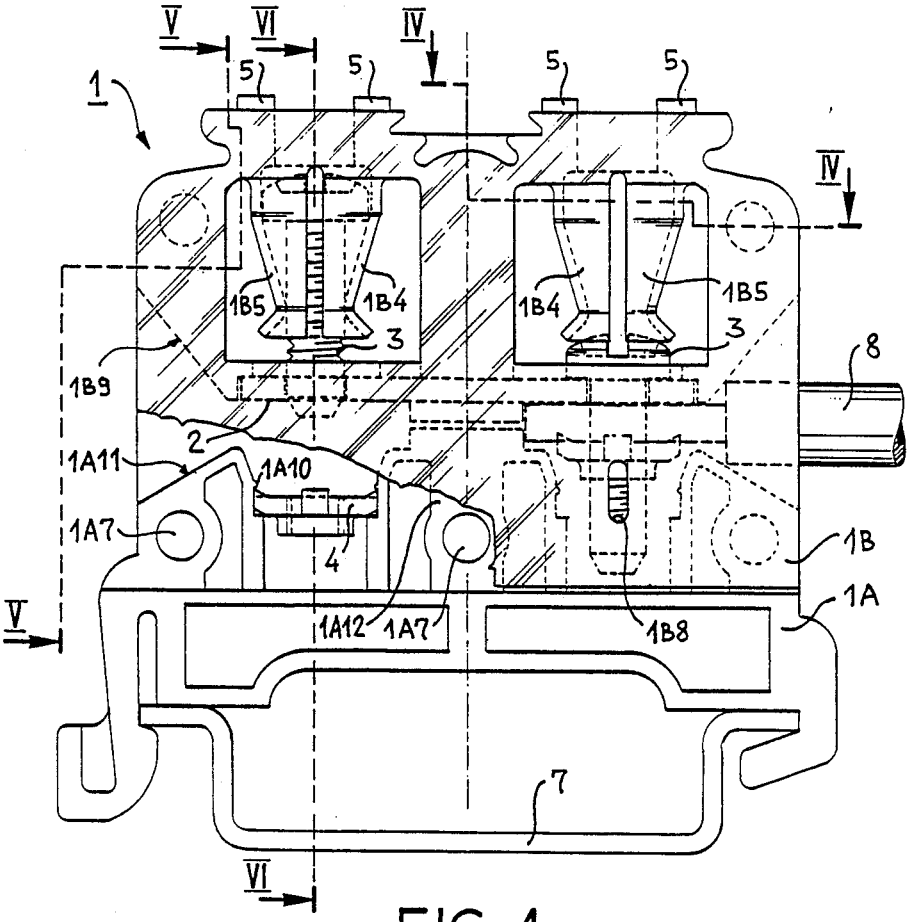
FIGS. 3 is a front view, partly cut away, of a connecting means like that of FIG. 1, as installed.

At least one wire 8 and/or at least one terminal lug, not shown, is inserted between the clamping plate 4 and the conductive wall of a facing connecting link 2, via an inlet in the side wall, located in the drawing of FIGS. 1 and 3 between interior walls 1A11 and 1B9 in mating parts 1A, 1B, such that the wire 8, going beneath the connecting link 2 and between the latter and a clamping plate 4, butts, in the selected example, against a tab 1B1 and a central pillar 1A12. Screwing in the screw 3, whose head bears upon the connecting link 2, causes the clamping plate 4 to rise out of its compartment, in the illustrated example by overcoming the retaining protrusions 1A10, and to secure the wire 8 against the connecting link 2.

The procedure for connecting a terminal lug is almost the same as just described, the only difference being that a ring tongue must be inserted between the clamping plate 4 and the screw 3 before screwing in the screw and that a tongue does not necessarily butt against the tab 1B1 and center pillar 1A12, the screw 3 itself serving as a stop for both openended and closed tongues.

If one completely unscrews screw 3, the screw's head will bear against the extensions 1B4, 1B5 thereabove, as shown at right in FIG. 3, and the plate 4 will return retainingly into its compartment while the screw head returns between the extensions 1B4, 1B5 whose free ends again bear against the screw 3 shank.

FIGS. 7 through 9 illustrate an alternate embodiment of the inventive connecting means, in which at least one connecting terminal equipped with a screw 3' retainer comprises a clamping plate 4' fitted under the head of the screw 3' which slides into a threaded hole 2'A of the connecting link 2', which is itself fixed in the case 1'.

The case 1' proposed in this embodiment also comprises two mating molded parts 1A', 1B' connected by flexible straps 5' serving as hinges, which enables their folding together without dissociating them. The mating parts snap together by engaging pins and catch holes as indicated for the first embodiment discussed.

In this embodiment, the clamping plates 4' are attached to the screws 3' under the heads whereof they are engaged in a known manner not part of the claims for this invention, being free to rotate but rotatively locked with their carrying screws.

Each screw 3' and its clamping plate 4' can move in translation within a retainer similar to that already described, such as to be sprung back within the retainer to leave a passage for a ring-tongue terminal between the end of the screw 3' and the stationary connecting link 2 into which the screw end screws.

To this end the connecting link 2' comprises a tapped hole 2'A whose center corresponds with the screw's axis of movement as defined by the given retainer.

The retainer in this case comprises two elastic extensions 1B4', 1B5' carried by one of the mating parts of case 1'. In the example shown, these extensions 1B4', 1B5' consist of looped straps issuing from protrusions on the inside wall of the part from which they loop out. One of these loops in the illustrated embodiment is common to two adjacent terminals of the connecting means. Each of the two extensions 1B4', 1B5' of one terminal is shaped to delimit, in cooperation with its neighboring extension, a compartment beneath an opening giving access to the screw 3' head of that terminal, said access opening being obtained in the same way as that provided in the previously described embodiment.

Each compartment arranged between two extensions 1B4', 1B5' has sides closed by the inside wall of part 1B' which carries it and from which the extensions 1B4', 1B5' loop out on the one hand, and by the inside wall of the mated part 1A'. The clamping plate 4' is at least basically square or rectangular shaped and slides along the inside walls 1A13', 1B13' of mating parts 1A', 1B' which thus guide the screw 3' in its travel.

The loops formed by extensions 1B4' and 1B5' are shaped such as to establish a compartment of conical shape tending to push back the screw 3' and its clamping plate 4' to the bottom of their compartment, with the screw head directly under its associated tool access opening and the screw shank aligned with the center of the corresponding tapped hole 2A' in the connecting link 2'.

To implement the connecting means each screw 3', carrying its plate 4', is positioned in its retainer between extensions 1B4', 1B5' and against the inside wall of the mating part 1B' carrying them.

The link 2' is pushed into retained position in its compartment in part 1A' and the two parts 1A' and 1B' are then mated.

The length of the terminal screws 3' is selected so that a space remains between each screw point and the connecting link 2' for passage of a closed wire terminal, not illustrated, beneath the screw, through the wire or terminal lug inlet bounded in this embodiment by a wall 1B8', termed the outside wall of the looped extension 1B5', a protruding wall 1A11' of part 1A' and the inside faces of parts 1A', 1B'.

Insertion of a screwdriver tip through the tool access opening to the screw 3' head allows the latter to be pushed into the tapped hole 2A' of the connecting link 2', urging outwardly the extensions 1B4', 1B5' as the screw is screwed in. The clamping plate 4' carried along by the screw 3' then clamps any wire or lug inserted through an inlet defined by exterior outside wall 1B8' and protruding wall 1A11', respectively, against the connecting link 2.

Subsequent unscrewing of screw 3' brings it back above the bulges formed by extensions 1B4', 1B5', which tend to urge it back towards the access opening and effectively do urge it there from the moment the shank of this screw 3' disengages from the threaded hole 2A'.

We claim:

1. In a connecting means for connecting electrical wires and/or wire terminal lugs including at least one connecting terminal comprising a screw having a head and a shank and being designed to fix at least one wire and/or wire terminal lug between a conducting wall of a connecting part and a clamping plate, said screw traversing said connecting part and said clamping plate to bring said connecting part and said clamping plate connectively together, said connecting terminal being housed in a case of insulating material having an inlet for introducing the wire and/or the wire terminal lug and an opening for accessing said head of the screw for purposes of maneuvering same, the improvement wherein the terminal comprises a screw retainer molded together with the case and arranged to guide the screw in longitudinal movements between an open position in which the screw, the connecting part and the clamping plate create between them a passage for a wire terminal, and a blocking position in which the clamping plate and the connecting part are brought together and retract the screw in open position into the screw retainer, by the screw retainer pressing beneath the screw head, at least at the end of unscrewing.

2. Connecting means according to claim 1, wherein said screw retainer comprises screw retaining means, said retaining means comprising elastic extensions integrally molded in the insulating case, which press up under its head to urge the screw back into open position which elastic extensions surround said screw when said screw is at least partially unscrewed from its clamped position and in which said extensions overhang at least part of the screw head.

3. Connecting means according to claim 2, wherein the elastic extensions of the terminal screw retaining means have free ends and establish a region near said free ends for guiding the screw shank in translation along the common axis of connecting link holes through which the screw passes, in the clamping plate and the connecting link, below the screw head when the latter is in open position.

4. Connecting means according to claim 2, wherein the insulating case consists of at least two parts which mate to form screw retaining means allowing longitudinal movement of the screw of at least one terminal while preventing side motion of the screw to keep the screw aligned and movable in alignment with the center of the clamping plate and the connecting link holes with which it cooperates.

5. Connecting means according to claim 4, wherein the two mating parts of the case are connected by flexible molded straps defining a folding hinge for matingly assembling the block formed by said parts and the terminal components they enclose.

6. Connecting means according to claim 4, wherein said at least one terminal molded screw retaining means elastic extensions are attached to at least one inside wall of one of the case parts so as to form a screw holding chimney and a screw screw guiding runner arranged on the other mating part is closed by said elastic extensions of said one case part.

7. Connecting means according to claim 6, wherein at least one of said case parts has a tool access opening and said screw holding chimney has a double conical shape extending longitudinally beneath the tool access opening to the screw head of a terminal, in line with the axis of a tapped hole for the screw of the given terminal in the connecting link, so as to overhang the head of said screw when it is in clamping position and to urge the head of the screw back towards said access opening when the screw is at the end of unscrewing.

8. Connecting means according to claim 6, wherein said at least one connecting terminal has a terminal screw and a connecting link of the strip type inserted laterally into retained position in one of the mating parts of the case and said clamping plate is inserted laterally into retained position in the other mating part and said two parts are folded together and form a folding assembly completely locking in place the connecting link and clamping the screw and clamping plate in place between the mating parts.

9. Connecting means according to claim 4, wherein said at least one connecting terminal screw retaining means are molded and said two elastic extensions are attached at least to the inside wall of one of the mating parts of the case so as to form a screw holding chimney made up of said two extensions and inside walls of the case's two mating parts.

10. Connecting means according to claim 9, wherein said elastic extensions forming the screw retaining means of said at least one connecting terminal are each made up of one strap formed into a loop, the loops looping out between case inside walls and defining a conically shaped screw holder tapering out towards the terminal screw head access opening so as to overhang the screw head when said screw is in clamping position and to urge the screw head back towards the access opening when the screw is nearly fully unscrewed.

11. Connecting means according to claim 10, wherein said at least one connecting terminal has a terminal screw with a clamping plate beneath the screw head, movable in rotation with the screw, said screw being inserted laterally into retained position along with said plate in one of the mating parts of the case and the connecting link being inserted into retained position in the other mating part, prior to assembly and said two parts being folded matingly together and completely locking in place the connecting link and clamping the screw and its clamping plate into place between the two mating parts.

* * * * *